US010150318B2

(12) United States Patent
Ota et al.

(10) Patent No.: US 10,150,318 B2
(45) Date of Patent: Dec. 11, 2018

(54) RECORDING MEDIUM AND PRODUCTION PROCESS THEREOF

(71) Applicant: CANON KABUSHIKI KAISHA, Tokyo (JP)

(72) Inventors: Takeshi Ota, Yokohama (JP); Yoshiyuki Nagase, Kawasaki (JP); Masaya Asao, Yokohama (JP); Olivia Herlambang, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/463,214

(22) Filed: Mar. 20, 2017

(65) Prior Publication Data

US 2017/0282629 A1 Oct. 5, 2017

(30) Foreign Application Priority Data

Mar. 31, 2016 (JP) ..... 2016-071999

(51) Int. Cl.
*B41M 5/50* (2006.01)
*B41M 5/52* (2006.01)

(52) U.S. Cl.
CPC ..... *B41M 5/52* (2013.01); *B41M 5/50* (2013.01); *B41M 5/5218* (2013.01); *B41M 5/5227* (2013.01); *B41M 5/5254* (2013.01); *B41M 5/5272* (2013.01); *B41M 5/5281* (2013.01)

(58) Field of Classification Search
CPC ..... B41M 5/50; B41M 5/5218; B41M 5/5227
See application file for complete search history.

(56) References Cited

U.S. PATENT DOCUMENTS

| | | | | |
|---|---|---|---|---|
| 7,935,397 | B2 | 5/2011 | Okuda et al. | |
| 7,955,669 | B2 | 6/2011 | Nagase et al. | |
| 8,163,360 | B2 | 4/2012 | Asao et al. | |
| 8,247,042 | B2 | 8/2012 | Asakawa et al. | |
| 8,247,043 | B2 | 8/2012 | Tanaka et al. | |
| 8,252,392 | B2 | 8/2012 | Oguri et al. | |
| 8,252,393 | B2 | 8/2012 | Nagashima et al. | |
| 8,486,499 | B2 | 7/2013 | Nilo et al. | |
| 8,524,336 | B2 | 9/2013 | Oguri et al. | |
| 8,545,008 | B2 | 10/2013 | Asao et al. | |
| 8,609,209 | B2 | 12/2013 | Taguri et al. | |
| 8,795,798 | B2 | 8/2014 | Oguri et al. | |
| 8,846,166 | B2 | 9/2014 | Herlambang et al. | |
| 2003/0219569 | A1* | 11/2003 | Aono | B32B 27/10 428/141 |
| 2006/0068132 | A1* | 3/2006 | Nakao | G03F 7/2018 428/32.34 |
| 2009/0035489 | A1* | 2/2009 | Kaimoto | B41M 5/502 428/32.1 |
| 2009/0324857 | A1 | 12/2009 | Okuda et al. | |
| 2011/0027505 | A1* | 2/2011 | Majumdar | B41M 5/5281 428/32.52 |

FOREIGN PATENT DOCUMENTS

| | | | | |
|---|---|---|---|---|
| EP | 0903246 | A2 | 3/1999 | |
| EP | 1180436 | A1 | 2/2002 | |
| JP | H10-272832 | A | 10/1998 | |
| JP | 2000-079756 | A | 3/2000 | |
| JP | 2000-318304 | A | 11/2000 | |
| JP | 2001-001629 | A | 1/2001 | |
| JP | 2001-105717 | A | 4/2001 | |
| JP | 2002-052812 | A | 2/2002 | |
| JP | 2002127588 | A * | 5/2002 | B41M 5/00 |
| JP | 4168823 | B2 | 10/2008 | |

OTHER PUBLICATIONS

Sep. 19, 2017 European Search Report in European Patent Appln. No. 17000487.3.

* cited by examiner

*Primary Examiner* — Betelhem Shewareged
(74) *Attorney, Agent, or Firm* — Venable LLP

(57) ABSTRACT

A recording medium including a substrate and an ink-receiving layer. The ink-receiving layer contains an inorganic particle, a water-insoluble resin and at least one additive selected from the group consisting of a benzotriazole ultraviolet absorber and a hindered amine photostabilizer. The average pore radius of the inorganic particle is 5.0 nm or less.

13 Claims, No Drawings

RECORDING MEDIUM AND PRODUCTION PROCESS THEREOF

BACKGROUND OF THE INVENTION

Field of the Invention

The present invention relates to a recording medium and a production process thereof.

Description of the Related Art

In recent years, a recorded article obtained by recording an image on a recording medium by means of an image recording method of an ink jet system may have been displayed outdoors in some cases. In a recording medium used for the formation of an image for being displayed outdoors, an ink-receiving layer thereof is required to have high lightfastness and water resistance. A recording medium obtained by causing an acrylic resin, a urethane resin or the like to be contained in an ink-receiving layer is known as a technique for improving the lightfastness and water resistance of the ink-receiving layer (Japanese Patent Application Laid-Open Nos. 2000-318304, 2002-052812, 2001-001629, 2001-105717, H10-272832 and 2000-079756, and Japanese Patent No. 4168823).

SUMMARY OF THE INVENTION

The present invention is intended to provide a recording medium excellent in lightfastness and water resistance and a production process for that recording medium.

In an aspect of the present invention, there is provided a recording medium having a substrate and an ink-receiving layer, wherein the ink-receiving layer contains an inorganic particle, a water-insoluble resin and at least one additive selected from the group consisting of a benzotriazole ultraviolet absorber and a hindered amine photostabilizer, and the average pore radius of the inorganic particle is 5.0 nm or less.

In another aspect of the present invention, there is also provided a production process for a recording medium, the process including the steps of preparing a coating liquid for an ink-receiving layer which contains an inorganic particle, a water-insoluble resin and at least one additive selected from the group consisting of a benzotriazole ultraviolet absorber and a hindered amine photostabilizer, and applying the coating liquid for the ink-receiving layer on to a substrate followed by drying, wherein the average pore radius of the inorganic particle is 5.0 nm or less.

Further features of the present invention will become apparent from the following description of exemplary embodiments.

DESCRIPTION OF THE EMBODIMENTS

Preferred embodiments of the present invention will now be described in detail.

According to an investigation by the present inventions, a recording medium excellent in both lightfastness and water resistance has been unable to be obtained by the techniques described in Japanese Patent Application Laid-Open Nos. 2000-318304, 2002-052812, 2001-001629, 2001-105717, H10-272832 and 2000-079756, and Japanese Patent No. 4168823. The present inventors have carried out an extensive investigation with a view toward providing a recording medium excellent in both lightfastness and water resistance and a production process for that recording medium, thus leading to the completion of the present invention. The present invention will hereinafter be described in detail by preferred embodiments.

Recording Medium:

The recording medium according to the present invention has a substrate and an ink-receiving layer. The ink-receiving layer contains an inorganic particle, a water-insoluble resin and at least one additive selected from the group consisting of a benzotriazole ultraviolet absorber and a hindered amine photostabilizer (hereinafter also referred to as an additive). In addition, the average pore radius of the inorganic particle is 5.0 nm or less. In the present invention, the recording medium excellent in both lightfastness and water resistance can be provided by satisfying these constituent features. A detailed mechanism by which the recording medium excellent in both lightfastness and water resistance can be provided by satisfying the above-mentioned constituent features is not clearly known, but is presumed to be as follows.

In order to realize good lightfastness in the case where a recording medium is displayed outdoors, it is considered to add an additive into the ink-receiving layer. However, a detailed investigation by the present inventors has revealed that an inorganic particle absorbs the additive upon formation of the ink-receiving layer, and so the additive may not sufficiently exhibit its original function in some cases. In more detail, it is inferred that the following phenomenon occurs.

When an ink-receiving layer containing an additive is formed, the ink-receiving layer can be formed by applying a coating liquid for the ink-receiving layer which contains, for example, an inorganic particle, a binder and the additive on to a substrate followed by drying. Here, primary particles of the inorganic particle mutually aggregate, thereby forming a secondary particle composed of a large number of primary particles. Further, the secondary particle is mutually bound by a binder, thereby forming the ink-receiving layer. If the additive is absorbed in a pore of the inorganic particle when the ink-receiving layer is formed by drying the coating liquid for the ink-receiving layer, the amount of the additive which is present in the interspace of the inorganic particle decreases. In general, when the additive is present in the vicinity of a coloring material, the effect of the additive is sufficiently exhibited. In particular, when an ink is a pigment ink, the pigment remains in the interspace of the inorganic particle without being absorbed in the pore of the inorganic particle, so that the effect of the additive is more impaired when the amount of the additive which is present in the vicinity of the pigment decreases. Thus, the present inventors have found that the absorption of the additive in the pore of the inorganic particle can be sufficiently inhibited by controlling the average pore radius of the inorganic particle to 5.0 nm or less, and so the additive can exhibit its original function to greatly improve the lightfastness.

On the other hand, the present inventors have investigated about the outdoor display of the recording medium. As a result, it has been found that when a water-soluble resin is used as a binder, the water-soluble resin is dissolved out due to the influence of rainwater or the like, and so the inorganic particle and a resin component come off. As a result, lowering of the film strength of a surface of the resulting recording medium and color fading due to the coming off of the inorganic particle have occurred. Further, it has been found that the lightfastness is also lowered because the additive is also dissolved out together with the water-soluble resin in association with the dissolution of the water-soluble resin. Thus, the present inventors have found that the water resistance of the ink-receiving layer can be improved by using a water-insoluble resin as the binder, and moreover the lightfastness can also be improved. In this manner, the respective components contained in the ink-receiving layer give an effect synergistically in the present invention, whereby the improvements in lightfastness and water resistance can be achieved at a high level.

The respective constituent features of the recording medium according to the present invention will hereinafter be described respectively. Incidentally, the recording medium according to the present invention is favorably an ink jet recording medium used in an ink jet recording method.

Substrate:

As the substrate, those already utilized for a recording medium or those usable for a recording medium and capable of functioning as a support of an ink-receiving layer may be utilized without limitation. As examples of the substrate, there are mentioned that composed of only base paper, that composed of only plastic film and that composed of only cloth. In addition, that provided with a plurality of layers may also be used as the substrate. Specifically, that having a paper base and a resin layer, that is, a resin-coated substrate, is mentioned. In the present invention, the resin-coated substrate, plastic film or cloth is favorably used as the substrate from the viewpoint of using the recording medium for the outdoor display.

In the present invention, the thickness of the substrate is favorably 50 μm or more to 400 μm or less, more favorably 70 μm or more to 200 μm or less. Incidentally, the thickness of the substrate in the present invention is calculated according to the following method. First, a section of the recording medium is cut out by a microtome, and that section is observed through a scanning electron microscope. The thickness of the substrate is then measured at arbitrary 100 or more points thereof, and the average value thereof is taken as the thickness of the substrate. Incidentally, the thicknesses of other layers in the present invention are also calculated according to the same method.

(1) Resin-coated Substrate

Base Paper

The base paper is made by using wood pulp as a main raw material and adding synthetic pulp such as polypropylene and synthetic fiber such as nylon or polyester as needed. As examples of the wood pulp, there are mentioned Laubholz bleached kraft pulp (LBKP), Laubholz bleached sulfite pulp (LBSP), Nadelholz bleached kraft pulp (NBKP), Nadelholz bleached sulfite pulp (NBSP), Laubholz dissolving pulp (LDP), Nadelholz dissolving pulp (NDP), Laubholz unbleached kraft pulp (LUKP) and Nadelholz unbleached kraft pulp (NUKP). These may be used either singly or in any combination thereof. Among the wood pulps, LBKP, LBSP, NBSP, LDP or NDP which contains a large amount of short fiber components is favorably used. Chemical pulp (sulfate pulp or sulfite pulp) which contains little impurities is favorable as the pulp. In addition, pulp whose brightness is improved by conducting a bleaching treatment is also favorable. Incidentally, a sizing agent, a white pigment, a paper strengthening agent, a fluorescent whitening agent, a water retaining agent, a dispersant, a softening agent and/or the like may be suitably added into the base paper.

In the present invention, the thickness of the base paper is favorably 50 μm or more to 130 μm or less, more favorably 90 μm or more to 120 μm or less. Incidentally, the thickness of the base paper in the present invention is calculated according to the same method as in the thickness of the substrate.

The paper density of the base paper as defined by JIS P 8118 in the present invention is favorably 0.6 g/cm$^3$ or more to 1.2 g/cm$^3$ or less, more favorably 0.7 g/cm$^3$ or more to 1.2 g/cm$^3$ or less.

Resin Layer

The resin layer may be provided on only one surface or both surfaces of the base paper. In the present invention, the resin layer is favorably provided on both surfaces of the base paper. In addition, when the base paper is coated with a resin, the resin layer may be provided so as to coat a part of a surface of the base paper. The coating rate of the resin layer (an area of the surface of the base paper coated with the resin layer/the whole area of the surface of the base paper) is favorably 70% or more, more favorably 90% or more, particularly favorably 100%, that is, the whole surface of the base paper being coated with the resin layer.

In addition, the thickness of the resin layer in the present invention is favorably 20 μm or more to 60 μm or less, more favorably 35 μm or more to 50 μm or less. When the resin layer is provided on both surfaces of the base paper, the thicknesses of the resin layers on both surfaces favorably satisfy the above range, respectively.

The resin used in the resin layer is favorably a thermoplastic resin. As examples of the thermoplastic resin, there are mentioned an acrylic resin, an acrylic silicone resin, a polyolefin resin and a styrene-butadiene copolymer. Among these, the polyolefin resin is favorably used. Incidentally, the polyolefin resin in the present invention means a polymer obtained by using an olefin as a monomer. As specific examples of the polyolefin resin, there are mentioned homopolymers and copolymers of ethylene, propylene, isobutylene and the like. These may be used either singly or in any combination thereof. Among these, polyethylene is favorably used. Low density polyethylene (LDPE) or high density polyethylene (HDPE) is favorably used as the polyethylene.

In the present invention, the resin layer may contain a white pigment, a fluorescent whitening agent, a bluing agent such as ultramarine blue and/or the like for adjusting opacity, brightness and hue. Among these, the white pigment is favorably contained because the opacity can be improved. As examples of the white pigment, there are mentioned rutile-type and anatase-type titanium oxides. When the white pigment is used, the content of the white pigment in the resin layer is favorably 3 g/m$^2$ or more to 30 g/m$^2$ or less. Incidentally, when the resin layer is provided on both surfaces of the base paper, the total content of the white pigment in the resin layers on both surfaces favorably satisfies the above range. In addition, the content of the white pigment in the resin layer is favorably 25% by mass or less with respect to the content of the resin. If the content of the white pigment exceeds 25% by mass, the dispersion stability of the white pigment may not be sufficiently achieved in some cases.

The arithmetic average roughness Ra of the resin layer as defined by JIS B 0601:2001 in the present invention is favorably 0.12 μm or more to 0.18 μm or less, more favorably 0.13 μm or more to 0.15 μm or less. In addition, the average length RSm of a roughness curve element of the resin layer as defined by JIS B 0601:2001 in the present invention is favorably 0.01 mm or more to 0.20 mm or less, more favorably 0.04 mm or more to 0.15 mm or less.

(2) Plastic Film

In the present invention, a plastic means that containing, as a component, a polymer having a weight-average molecular weight of 10,000 or more at a proportion of 50% by mass or more, and a plastic film means that obtained by processing the plastic into a film form. The plastic used in the plastic film is a thermoplastic polymer. As specific examples of the thermoplastic polymer, there are mentioned a vinyl-based plastic, a polyester-based plastic, a cellulose ester-based plastic, a polyamide-based plastic and a heat-resistant engineering plastic.

As examples of the vinyl-based plastic, there are mentioned polyethylene, polyvinyl chloride, polyvinylidene chloride, polyvinyl alcohol, polystyrene, polypropylene and fluorine-containing resins. As examples of the polyester-based plastic, there are mentioned polycarbonate and polyethylene terephthalate. As examples of the cellulose ester-based plastic, there are mentioned cellulose diacetate, cellulose triacetate and cellulose acetate butyrate. As examples of the polyamide-based plastic, there are mentioned nylon 6, nylon 66 and nylon 12. As examples of the heat-resistant engineering plastic, there are mentioned polyimide, polysulfone, poly(ether sulfone), polyphenylene sulfide, poly(ether ether ketone) and polyether imide. These may be used either singly or in any combination thereof. Among these, polyvinyl chloride, polypropylene, polycarbonate or polyethylene terephthalate is favorably used in the present invention from the viewpoints of durability and cost.

In addition, synthetic paper obtained by subjecting the above-described plastic to such a treatment as a chemical treatment, surface coating or internal addition to improve the opacity thereof may also be used as the plastic film in the present invention. As the chemical treatment, there is mentioned a method in which the surfaces of the plastic film are dipped in an organic solvent such as acetone or methyl isobutyl ketone, thereby producing a swelled layer, and then the swelled layer is dried and solidified with another organic solvent such as methanol. As the surface coating, there is mentioned a method of forming a layer composed of a white pigment such as calcium carbonate or titanium oxide and a binder on a surface of the plastic. In addition, the internal addition includes a method of mixing a pigment such as calcium carbonate, titanium oxide, zinc oxide, white carbon, clay, talc or barium sulfate into the plastic as a filler. Further, a foamed plastic film whose opacity is improved by adding a polybutylene terephthalate fine particle, a polycarbonate fine particle, a polyester resin, a polycarbonate resin or the like to form voids in the plastic may also be used.

In the present invention, the thickness of the plastic film is favorably 50 μm or more to 300 μm or less, more favorably 75 μm or more to 135 μm or less.

The glass transition point (Tg) of the plastic used in the plastic film in the present invention is favorably −20° C. or more to 150° C. or less, more favorably—20° C. or more to 80° C. or less. Incidentally, the glass transition point in the present invention can be measured by, for example, the differential scanning calorimetry (DSC method).

The plastic density of the plastic film as defined by JIS K 7112:1999 in the present invention is favorably 0.6 g/cm$^3$ or more to 1.5 g/cm$^3$ or less, more favorably 0.7 g/cm$^3$ or more to 1.4 g/cm$^3$ or less.

The water absorption rate of the plastic film as defined by JIS K 7209:2000 in the present invention is favorably 5% or less, more favorably 1% or less.

In addition, when the plastic film is used, the adhesion between the ink-receiving layer and the plastic film can be improved by conducting a surface treatment by a surface oxidation treatment. As examples of the surface oxidation treatment, there are mentioned a corona discharge treatment, a flame treatment, a plasma treatment, a glow discharge treatment and an ozone treatment. These may be used either singly or in any combination thereof. Among these, the ozone treatment is favorable. The treatment rate of the ozone treatment is favorably 10 to 200 W·min/m$^2$, more favorably 50 to 150 W·min/m$^2$.

(3) Cloth

In the present invention, the cloth means that obtained by thinly and widely processing a large amount of fiber in the form of a plate. As the kinds of the fiber, there are mentioned natural fiber, recycled fiber recycled from a material having the nature of the natural fiber or from a plastic, and synthetic fiber obtained by using a polymer such as petroleum as a raw material. As examples of the natural fiber, there are mentioned cotton, silk, hemp, mohair, wool and cashmere. In addition, as examples of the recycled fiber, there are mentioned acetate, cupra, rayon and recycled polyester. Further, as examples of the synthetic fiber, there are mentioned nylon, polyester, acrylic, vinylon, polyethylene, polypropylene, polyamide and polyurethane.

Ink-receiving Layer:

The ink-receiving layer according to the present invention contains an inorganic particle, a water-insoluble resin and at least one additive selected from the group consisting of a benzotriazole ultraviolet absorber and a hindered amine photostabilizer. In addition, the ink-receiving layer may contain other additives than the above-described materials as needed. The ink-receiving layer may be provided on only one surface or both surfaces of the substrate. In addition, the ink-receiving layer may be a single layer or a multi-layer of two or more layers. When the ink-receiving layer is composed of the multi-layer of two or more layers, however, the outermost layer thereof favorably contains at least an inorganic particle and a water-insoluble resin. The thickness of the ink-receiving layer is favorably 1 μm or more to 50 μm or less.

Inorganic Particle

In the present invention, the inorganic particle has a pore structure, and the average pore radius thereof is 5.0 nm or less. If the average pore radius is larger than 5.0 nm, the additive is easier to enter into the pore of the inorganic particle, and so the amount of the additive to be absorbed in the inorganic particle increases. As a result, the amount of the additive remaining in the interspace of the inorganic particle decreases to lower the lightfastness. The average pore radius is favorably 4.5 nm or less, more favorably 4.0 nm or less, still more favorably 3.5 nm or less. In addition, the average pore radius is favorably 1.5 nm or more, more favorably 2.5 nm or more from the viewpoint of ink absorbency. Incidentally, the average pore radium is a value measured by a method described later. In addition, the average pore radius may be defined as the average pore radius of pores formed in interspaces among primary particles of the inorganic particle in a secondary particle which is an aggregate of the primary particles.

The oil absorption of the inorganic particle is favorably 150 ml/100 g or more to 240 ml/100 g or less. The oil absorption of the inorganic particle is 150 ml/100 g or more, whereby a sufficient number of pores are present in the inorganic particle, and so such an inorganic particle is suitable for an ink jet recording medium. On the other hand, the oil absorption of the inorganic particle is 240 ml/100 g or less, whereby the water resistance of the resulting recording medium is improved. The oil absorption of the inorganic particle is more favorably 170 ml/100 g or more to 235 ml/100 g or less, still more favorably 200 ml/100 g or more to 230 ml/100 g or less. Incidentally, the oil absorption of the inorganic particle is a value measured by a method described later. In addition, since a residue obtained by scraping the ink-receiving layer from the recording medium followed by heating for 2 hours at a temperature of 600° C. or less is the inorganic particle, the average pore radius and oil absorption of the inorganic particle contained in the recording medium can be verified by conducting the measurement on that inorganic particle.

The average secondary particle size of the inorganic particle is favorably 1 μm or more to 20 μm or less, more favorably 2 μm or more to 10 μm or less. Incidentally, the average secondary particle size is a value measured by a laser diffraction type particle size distribution measuring apparatus.

As examples of the inorganic particle used in the present invention, there are mentioned alumina hydrate, alumina, silica, colloidal silica, titanium dioxide, zeolite, kaolin, talc, hydrotalcite, zinc oxide, zinc hydroxide, aluminum silicate, calcium silicate, magnesium silicate, calcium carbonate, zirconium oxide and zirconium hydroxide. These inorganic particles may be used either singly or in any combination thereof. Among the inorganic particles, silica is favorably used from the viewpoint of being able to form a porous structure with high ink absorbency.

As examples of the silica, there are mentioned wet-process silica and dry-process (gas-phase process) silica. The wet-process silica is obtained by producing active silica by, for example, acid decomposition of a silicate and moderately polymerizing this silica followed by aggregation and precipitation thereof. On the other hand, the dry-process (gas-phase process) silica is obtained by a process using high-temperature gas phase hydrolysis of, for example, a silicon halide (flame hydrolysis process) or by a process of heating, reducing and gasifying silica sand and coke by an arc in an electric furnace and then oxidizing this product in the air (arc process). The wet-process silica is favorable as the above-mentioned silica from the viewpoint of being able to satisfy the above-described ranges of the average pore radius and oil absorption. As examples of the wet-process silica, there are mentioned precipitated silica and gel-process silica.

As an example of a production process for the gel-process silica, there may be mentioned the following process. First, silica hydrosol is gelled which is produced by causing a silicate to react with an inorganic acid in such a manner that the concentration of $SiO_2$ is 10 to 20% by mass. As examples of the silicate, there are mentioned sodium silicate, potassium silicate and ammonium silicate. However, sodium silicate is favorable. In addition, as examples of the inorganic acid, there are mentioned sulfuric acid, nitric acid and hydrochloric acid. However, sulfuric acid is favorable. Here, the concentration of $SiO_2$ falls within the above range, whereby uniform and fine silica hydrogel is obtained. When the fine silica hydrogel is used, a silica particle having a small pore radius and a high oil absorption is easily obtained.

The silica hydrogel obtained by the above process is then washed with water, thereby removing inorganic acid salts contained in the silica hydrogel. Thereafter, the silica hydrogel is subjected to a hydrothermal treatment. By the hydrothermal treatment, dissolution and deposition of a primary particle of the silica hydrogel occur to increase the average pore radius and oil adsorption. The temperature of the hydrothermal treatment is favorably 20 to 100° C., more favorably 40 to 60° C. The temperature of the hydrothermal treatment is controlled to 20° C. or more, whereby the degree of crosslinking of the resulting silica gel can be increased, the heat stability is improved, and a peak is exhibited in a pore distribution. In addition, the temperature of the hydrothermal treatment is controlled to 100° C. or less, whereby the average pore radius of the resulting silica gel can be made small. The pH of a solution in the hydrothermal treatment is favorably 5.0 to 7.5. The pH is controlled to 5.0 or more, whereby the treatment time can be shortened. In addition, the pH is controlled to 7.5 or less, whereby the average pore radius can be made small.

Thereafter, an acid treatment with an inorganic acid or organic acid having a pH of 2 to 5 is conducted. By conducting the acid treatment, the dissolution and deposition of the primary particle are inhibited to increase the oil absorption while suppressing the increase of the average pore radius.

The above-described hydrothermal treatment and acid treatment are important processes for determining the physical properties of the silica particle. In addition, since the physical properties of the resulting silica vary depending on the silica raw material and water used, the treatment temperature, pH and time are optimized while measuring the physical properties of the silica upon the production, whereby they can be adjusted to intended physical properties.

The resultant silica hydrogel is then ground and granulated by means of a ball mill or the like so as to give a silica particle having an average particle size of several micrometers. Thereafter, the particle is dried for 1 to 100 seconds at a temperature of 100 to 1,000° C., whereby a silica particle satisfying the requirements according to the present invention can be produced.

Water-insoluble Resin

In the present invention, the water-insoluble resin functions as a binder which mutually binds inorganic particles to form a film. Here, "water-insoluble resin" represents that 95% by mass or more of which remains when the resin is immersed for 2 hours in hot water of 80° C. The water-insoluble resin is favorably at least one resin selected from the group consisting of an acrylic resin, a polycarbonate-modified urethane resin and a polyether-modified urethane resin from the viewpoint of the water resistance. Incidentally, the polycarbonate-modified urethane resin and the polyether-modified urethane resin will hereinafter be also collectively referred to simply as "urethane resin". In addition, "modified" indicates the kind of a polyol used upon the production of the polyurethane resin, and three kinds of structures of polyether, polyester and polycarbonate are mainly used.

In the present invention, the acrylic resin means a polymer of a (meth)acrylic acid ester. The acrylic resin may be a homopolymer or a copolymer with another monomer so long as the (meth)acrylic acid ester is used as a monomer. Incidentally, "(meth)acrylic acid" means acrylic acid or methacrylic acid.

As examples of the acrylic acid ester, there are mentioned methyl acrylate, ethyl acrylate, butyl acrylate, 2-ethylhexyl acrylate, 2-dimethylaminoethyl acrylate, 2-hydroxyethyl acrylate, 2-hydroxypropyl acrylate, 2-hydroxybutyl acrylate, isobutyl acrylate, octyl acrylate, lauryl acrylate and stearyl acrylate. In addition, as examples of the methacrylic acid ester, there are mentioned methyl methacrylate, ethyl methacrylate, butyl methacrylate, 2-ethylhexyl methacrylate, 2-dimethylaminoethyl methacrylate, 2-hydroxyethyl methacrylate, 2-hydroxypropyl methacrylate, 2-hydroxybutyl methacrylate, isobutyl methacrylate, octyl methacrylate, lauryl methacrylate and stearyl methacrylate. As another monomer capable of copolymerizing with the (meth)acrylic acid ester, there is mentioned a vinyl monomer. As specific example of the vinyl monomer, there are mentioned styrene; styrene derivatives such as vinyltoluene, vinylbenzoic acid, α-methylstyrene, p-hydroxymethylstyrene and styrenesulfonic acid; and vinyl ethers such as methyl vinyl ether, butyl vinyl ether, methoxyethyl vinyl ether, N-vinylpyrrolidone, 2-vinyloxazone and vinylsulfonic acid, and derivatives thereof.

In the present invention, the acrylic resin is favorably a polyacrylic acid ester, a polymethacrylic acid ester or a copolymer of an acrylic acid ester and a methacrylic acid ester. Among others, a copolymer of a methacrylic acid ester having a relatively high glass transition point and an acrylic acid ester having a relatively low glass transition point is more favorable because the glass transition point of the finally obtained acrylic resin can be controlled by the copolymerization ratio thereof.

The urethane resin in the present invention means a resin having a urethane linkage. The urethane resin is favorably a compound obtained by reacting a polyisocyanate, a polyol and a chain extender.

Specifically, as examples of the polyisocyanate, there are mentioned aromatic isocyanates such as tolylene diisocyanate, diphenylmethane diisocyanate, polymeric diphenylmethane diisocyanate, tolidine diisocyanate, naphthalene diisocyanate, xylylene diisocyanate and tetramethylxylylene diisocyanate; aliphatic isocyanates such as hexamethylene diisocyanate and trimethylhexamethylene diisocyanate; and alicyclic isocyanates such as isophorone diisocyanate, cyclohexane-1,3-diisocyanate and cyclohexane-1,4-diisocyanate. These may be used either singly or in any combination thereof.

A polyether-based polyol such as polypropylene glycol, polyethylene glycol or polytetramethylene glycol is used as the polyol, thereby obtaining the polyether-modified urethane resin. In addition, a polycarbonate-based polyol such as polyhexamethylene carbonate is used as the polyol, thereby obtaining the polycarbonate-modified urethane resin. These polyols may be used either singly or in any combination thereof.

A low molecular weight glycol such as ethylene glycol, a low molecular weight diamine or a compound containing an active hydrogen atom, such as a low molecular weight aminoalcohol may be used as the chain extender. These may be used either singly or in any combination thereof.

The glass transition point (Tg) of the water-insoluble resin is favorably 20° C. or less. The Tg is 20° C. or less, whereby binding force between the water-insoluble resin and the inorganic particle can strengthen to improve the water resistance. The Tg is more favorably 15° C. or less, still more favorably 10° C. or less. Incidentally, the Tg is a value measured by the differential scanning calorimetry (DSC method).

The content of the water-insoluble resin with respect to 100.0 parts by mass of the inorganic particle is favorably 30.0 parts by mass or more to 80.0 parts by mass or less. The content is 30.0 parts by mass or more, whereby sufficient film strength is attained. In addition, the content is 80.0 parts by mass or less, whereby sufficient ink absorbency is attained. The content is more favorably 40.0 parts by mass or more to 70.0 parts by mass or less, still more favorably 50.0 parts by mass or more to 60.0 parts by mass or less.

Incidentally, when the ink-receiving layer contains the water-insoluble resin as the binder, the content of the water-insoluble resin with respect to 100.0 parts by mass of the inorganic particle is favorably 25.0 parts by mass or less, more favorably 20.0 parts by mass or less, still more favorably 10.0 parts by mass or less. In addition, the ink-receiving layer does particularly favorably not contain a water-soluble resin as the binder. The content is 25.0 parts by mass or less, whereby lowering of water resistance due to improvement in hydrophilicity on the surface of the recording medium can be inhibited.

Benzotriazole Ultraviolet Absorber and Hindered Amine Photostabilizer

A benzotriazole ultraviolet absorber and a hindered amine photostabilizer which are additives in the present invention are present in the ink-receiving layer, whereby a coloring material can be protected from color fading by gas, light or the like to improve the lightfastness of the coloring material. In the present invention, at least one additive selected from the group consisting of a benzotriazole ultraviolet absorber and a hindered amine photostabilizer is used.

The benzotriazole ultraviolet absorber represents that having a benzotriazole structure, exhibits absorption property in a wide wavelength range and is excellent in lightfastness in particular. As specific examples of the benzotriazole ultraviolet absorber, there are mentioned 2-(2'-hydroxy-3'-t-butyl-5'-methylphenyl)-5-chlorobenzotriazole, 2-(2'-hydroxy-3'-t-butyl-5'-octylphenyl propionate)-5-chlorobenzotriazole, 5'-octylphenyl propionate-5-chlorobenzotriazole, 2-(2'-hydroxy-5'-methylphenyl-5'-methylphenyl)benzotriazole, 2-(2'-hydroxy-5'-t-butylphenyl)benzotriazole, 2-(2'-hydroxy-3',5-di-t-butylphenyl)benzotriazole, 2-(2'-hydroxy-3',5-di-t-butylphenyl)-5-chlorobenzotriazole, 2-(2'-hydroxy-3',5-di-t-amylphenyl) and 2-[2-hydroxy-3,5-di(2,2-dimethylbenzyl)-phenyl]-2H-benzotriazole, but not limited to these. As examples of commercially available products thereof, there are mentioned Hostavin 3310disp (trade name, product of Clariant Co.), Hostavin 3326disp (trade name, product of JOHOKU CHEMICAL CO., LTD.) and SHINEGUARD NEW W51 (trade name, product of SENKA CORPORATION). These may be used either singly or in any combination thereof. In addition, other ultraviolet absorbers than the benzotriazole ultraviolet absorbers may also be used in combination in such a range as not to impair other performance. As specific examples thereof, there are mentioned a hydroxyphenyltriazine ultraviolet absorber, a phenylsalicylate ultraviolet absorber and a 2-hydroxybenzophenone ultraviolet absorber. These may be used either singly or in any combination thereof.

The hindered amine photostabilizer represents that having a hindered amine structure and sustains the effect of lightfastness because of sustaining a radical scavenging function by cyclically regenerating a nitroxy radical which acts as the radical scavenging function. As specific examples of the hindered amine photostabilizer, there are mentioned hindered amines such as 2-(3,5-di-t-butyl-4-hydroxybenzyl)-2-n-butylmalonic acid and bis(1,2,2,6-pentamethyl-4-piperidine), but not limited to these. As examples of commercially available products thereof, there are mentioned ADEKANOL UC-606 (trade name, product of ADEKA CORPORATION), SHINEGUARD HL-06 (trade name, product of SENKA CORPORATION) and Hostavin 3051-2disp (trade name, product of Clariant Co.). These may be used either singly or in any combination thereof. In addition, other radical scavengers than the hindered amine photostabilizers may also be used in combination in such a range as not to impair other performance. As specific examples thereof, there are mentioned a phenol derivative and an aromatic amine derivative. These may be used either singly or in any combination thereof.

The content of at least one additive selected from the group consisting of the benzotriazole ultraviolet absorber and the hindered amine photostabilizer with respect to 100.0 parts by mass of the inorganic particle is favorably 2.5 parts by mass or more to 10.0 parts by mass or less. The content is 2.5 parts by mass or more, whereby the effect of the benzotriazole ultraviolet absorber or the hindered amine photostabilizer can be sufficiently exhibited. In addition, the content is 10.0 parts by mass or less, whereby an aggregate is hard to occur in the coating liquid for the ink-receiving layer to make it hard to generate minute cracks or defects in the surface of the ink-receiving layer, so that occurrence of a portion which becomes a starting point of deterioration of the ink-receiving layer can be suppressed. The content is more favorably 2.7 parts by weight or more to 9.0 parts by weight or less, still more favorably 3.0 parts by mass or more to 7.0 parts by mass or less.

Other Additives

The ink-receiving layer may also contain other additives than the above-described components in such a range as not to impair the effect of the present invention. As examples of the other additives, there are mentioned hydroperoxide decomposers having a function of preventing deterioration of a coloring material, such as a thiourea compound, a thiuram compound and a phosphite compound. These may be used either singly or in any combination thereof.

In addition, as specific examples of the other additives, there are mentioned a crosslinking agent, a pH adjustor, a thickener, a flowability modifier, an antifoaming agent, a foam suppressor, a parting agent, a penetrant, a coloring pigment, a coloring dye, a fluorescent whitening agent, an antioxidant, an antiseptic, a mildewproofing agent, a waterproofing agent, an ink fixing agent, a curing agent and a weathering material.

As examples of the crosslinking agent, there are mentioned an aldehyde compound, a melamine compound, an isocyanate compound, a zirconium compound, a titanium compound, an amide compound, an aluminum compound, boric acid, a borate, a carbodiimide compound and an oxazoline compound.

In addition, another cationic resin than the above-described water-insoluble resin or a polyvalent metal salt is favorably contained as an ink fixing agent. As examples of the cationic resin, there are mentioned a polyethylene imine resin, a polyamine resin, a polyamide resin, a polyamide epichlorohydrin resin, a polyamine epichlorohydrin resin, a polyamide polyamine epichlorohydrin resin, a polydiallylamine resin and a dicyane diamide condensate. As examples of the polyvalent metal salt, there are mentioned a calcium compound, a magnesium compound, a zirconium compound, a titanium compound and an aluminum compound. Among these, the calcium compound is favorable, and calcium nitrate tetrahydrate is more favorable.

Production Process for Recording Medium:

The production process for the recording medium according to the present invention has the following steps. A step of preparing a coating liquid for an ink-receiving layer (hereinafter also referred to as a coating liquid) which contains an inorganic particle, a water-insoluble resin and an additive. A step of applying the coating liquid for the ink-receiving layer on to a substrate followed by drying. In addition, the average pore radius of the inorganic particle is 5.0 nm or less. According to this process, the recording medium according to the present invention can be easily produced to sufficiently achieve the effect of the present invention.

The coating liquid can be prepared by dispersing, for example, the inorganic particle, the water-insoluble resin and the additive in water which is a solvent. No particular limitation is imposed on the solid content concentration of the coating liquid. However, the concentration may be set to, for example, 10 to 30% by mass.

As a method for applying the coating liquid on to the substrate, there is mentioned a method of using a roll coater, a blade coater, a bar coater, an air knife coater, a gravure coater, a reverse coater, a transfer coater, a die coater, a kiss coater, a rod coater, a curtain coater, a coater using an extrusion system or a coater using a slide hopper system. Incidentally, the coating liquid may also be heated upon the application thereof. The application weight of the coating liquid is favorably 5 $g/m^2$ or more to 40 $g/m^2$ or less. The application weight of the coating liquid falls within the above range, whereby both improvement in ink absorbency and improvement in coating stability of the coating liquid can be attained. As methods for drying the coating liquid applied, there are mentioned a method of using a hot air dryer such as a linear tunnel dryer, an arch dryer, an air loop dryer or a sine curve air float dryer and a method of using a dryer utilizing infrared rays, heating dryers or microwaves. The heating temperature upon the drying of the coating liquid may be set to, for example, 80 to 130° C.

In addition, a surface treating liquid containing a surface treating agent may also be applied to a surface of the substrate to which the coating liquid is applied prior to the application of the coating liquid. Thus, the wettability of the substrate for the coating liquid can be improved to improve adhesion between the ink-receiving layer and the substrate. As examples of the surface treating agent, there are mentioned thermoplastic resins such as an acrylic resin, a polyurethane resin, a polyester resin, a polyethylene resin, a polyvinyl chloride resin, a polypropylene resin, a polyamide resin and a styrene-butadiene copolymer, and a silane coupling agent. These may be used either singly or in any combination thereof.

According to an embodiment of the present invention, there can be provided a recording medium excellent in lightfastness and water resistance and a production process for that recording medium.

EXAMPLES

The present invention will hereinafter be described in more detail by Examples and Comparative Examples. The present invention is not limited by the following Examples at all unless going beyond the gist thereof. Incidentally, "part(s)" in the following description of Examples is based on mass unless expressly noted.

Substrate:

NEW YUPO (trademark) FGS110 (product name, product of Yupo Corporation, thickness: 110 μm) which was propylene synthetic paper was provided as a substrate.

Preparation of Inorganic Particle Dispersion Liquids 1 to 7

Silica particles shown in Table 1 were provided as silica particles. The silica particles were respectively added into pure water in such a manner that the respective solid contents thereof were 18.0% by mass, and stirring by a mixer was conducted for 30 minutes to prepare the inorganic particle dispersion liquids 1 to 7. Incidentally, the synthetic silica particles 1 to 3 in Table 1 are synthetic silica particles produced according to the above-described process. Upon the production of the synthetic silica particles 1 to 3, the pH and temperature of water used in the hydrothermal treatment and the treatment time were suitably controlled, and grinding by a ball mill was performed so as to give a proper average particle size. In addition, the average pore radius of each inorganic particle was calculated by using the BJH (Barrett-Joyner-Halenda) method from an adsorption/desorption isotherm of nitrogen gas measured by Micromeritics Tristar-3000 (trade name, manufactured by Shimadzu Corporation). Specifically, the average pore radius was determined by calculation from the total pore volume and specific surface area measured upon desorption of the nitrogen gas. In addition, the oil absorption of the inorganic particle was measured by the linseed oil droplet method defined in JIS K 5101-13.

TABLE 1

| Inorganic Particle Dispersion Liquid | Inorganic particle | Average pore radius (nm) | Oil absorption (ml/100 g) |
|---|---|---|---|
| 1 | MIZUKASIL P-50 (trade name, product of Mizusawa Industrial Chemicals, Ltd.) | 4.5 | 200 |
| 2 | SYLYSIA 660 (trade name, product of Fuji Sylisia Chemical Ltd.) | 2.2 | 230 |
| 3 | Synthetic Silica Particle 1 | 3.1 | 230 |
| 4 | Synthetic Silica Particle 2 | 2.4 | 215 |
| 5 | Synthetic Silica Particle 3 | 4.6 | 250 |
| 6 | NIPGEL BY-800 (trade name, product of Tosoh Silica Corporation) | 5.1 | 215 |
| 7 | SYLYSLA 440 (trade name, product of Fuji Sylisia Chemical Ltd.) | 5.2 | 230 |

Preparation of Resins 1 to 7

The resins 1 to 7 shown in Table 2 were provided as resins used as binders. Incidentally, the Tg of each resin was measured by the differential scanning calorimetry (DSC method).

TABLE 2

| Resin | Trade name | Kind | Solubility in water | Tg (° C.) |
|---|---|---|---|---|
| 1 | Mowinyl 7820 (product of The Nippon Synthetic Chemical Industry Co., Ltd.) | Acrylic resin | Water-insoluble | 4 |
| 2 | Mowinyl 7720 (product of The Nippon Synthetic Chemical Industry Co., Ltd.) | Acrylic resin | Water-insoluble | 4 |
| 3 | Hydran WLS210 (product of DIC Corporation) | Polycarbonate-modified urethane resin | Water-insoluble | −15 |
| 4 | Hydran WLS201 (product of DIC Corporation) | Polyether-modified urethane resin | Water-insoluble | −50 |
| 5 | Vylonal MD1480 (product of TOYOBO CO., LTD.) | Polyester resin | Water-insoluble | 20 |
| 6 | Bonron T-733 (product of Mitsui Chemicals, Inc.) | Acrylic resin | Water-insoluble | 23 |
| 7 | PVA117 (product of Kuraray Co., Ltd.) | Polyvinyl alcohol | Water-soluble | — |

Additives 1 to 7

The additives 1 to 7 shown in Table 3 were provided as additives.

TABLE 3

| Additive | Trade name | Kind |
|---|---|---|
| 1 | Hostavin 3310 disp (product of Clariant Co.) | Benzotriazole ultraviolet absorber |
| 2 | SHINEGUARD NEW W51 (product of SENKA CORPORATION) | Benzotriazole ultraviolet absorber |
| 3 | Hostavin 3051-2 disp (product of Clariant Co.) | Hindered amine photostabilizer |
| 4 | ADEKANOL UC-606 (product of ADEKA CORPORATION) | Hindered amine photostabilizer |
| 5 | SHINEGUARD HL-06 (product of SENKA CORPORATION) | Hindered amine photostabilizer |
| 6 | Tinuvin 400 DW (product of BASF) | Hydroxyphenyltriazine ultraviolet absorber |
| 7 | SHINEGUARD TA-04 (product of SENKA CORPORATION) | Hydroxyphenyltriazine ultraviolet absorber |

Cationic Resins 1 and 2:

Cationic resins shown in Table 4 were provided as the cationic resins 1 and 2.

TABLE 4

| Cationic Resin | Trade name | Kind |
|---|---|---|
| 1 | PAA-HCl-10L (product of NITTOBO MEDICAL CO., LTD.) | Allylamine hydrochloride polymer |
| 2 | Pulset JK173 (product of Meisei Chemical Works, Ltd.) | Alkylamine-epichlorohydrin polycondensate |

Surfactants 1 and 2:

Surfactants shown in Table 5 were provided as the surfactants 1 and 2.

TABLE 5

| Surfactant | Trade name | Kind |
|---|---|---|
| 1 | Surfinol 440 (product of Nisshin Chemical Industry Co., Ltd.) | Acetylene glycol-based surfactant |
| 2 | Olfine E1004 (product of Nisshin Chemical Industry Co., Ltd.) | Acetylene glycol-based surfactant |

Preparation of Coating Liquids 1 to 25

The above-described inorganic particle dispersion liquids, resins, additives, cationic resins and surfactants, calcium nitrate as a polyvalent metal salt, and water were respectively mixed to prepare the coating liquids 1 to 25. Incidentally, the mixing amounts of the inorganic particle dispersion liquids, resins, additives, cationic resins and surfactants were set to such amounts that the respective solid contents by mass in the coating liquids were the values shown in Table 6. In addition, the mixing amount of calcium nitrate was set to 5 parts by mass in terms of solid content by mass in each coating liquid. The solid content concentrations of the coating liquids 1 to 25 were each 18% by mass. In addition, 1.5 parts by mass of Additive No. 1 and 1.5 parts by mass of Additive No. 3 were added into Coating Liquid No. 20.

TABLE 6

| Coating Liquid | Inorganic Particle Dispersion Liquid No. | Solid content (parts) | Resin No. | Solid content (parts) | Additive No. | Solid content (parts) | Cationic Resin No. | Solid content (parts) | Surfactant No. | Solid content (parts) |
|---|---|---|---|---|---|---|---|---|---|---|
| 1 | 1 | 100.0 | 1 | 58.3 | 1 | 3.0 | 1 | 10.0 | 1 | 2.5 |
| 2 | 1 | 100.0 | 2 | 58.3 | 2 | 3.0 | 1 | 10.0 | 1 | 2.5 |
| 3 | 1 | 100.0 | 3 | 58.3 | 1 | 3.0 | 1 | 10.0 | 1 | 2.5 |
| 4 | 1 | 100.0 | 4 | 58.3 | 2 | 3.0 | 1 | 10.0 | 1 | 2.5 |
| 5 | 1 | 100.0 | 5 | 58.3 | 1 | 3.0 | 1 | 10.0 | 1 | 2.5 |
| 6 | 1 | 100.0 | 6 | 58.3 | 2 | 3.0 | 2 | 10.0 | 1 | 2.5 |
| 7 | 2 | 100.0 | 1 | 58.3 | 1 | 3.0 | 2 | 10.0 | 2 | 2.5 |
| 8 | 3 | 100.0 | 2 | 58.3 | 2 | 3.0 | 2 | 10.0 | 2 | 2.5 |
| 9 | 4 | 100.0 | 1 | 58.3 | 2 | 3.0 | 2 | 10.0 | 2 | 2.5 |
| 10 | 5 | 100.0 | 1 | 58.3 | 1 | 3.0 | 2 | 10.0 | 2 | 2.5 |
| 11 | 1 | 100.0 | 2 | 58.3 | 2 | 3.0 | 2 | 10.0 | 2 | 2.5 |
| 12 | 1 | 100.0 | 1 | 58.3 | 3 | 3.0 | 2 | 10.0 | 2 | 2.5 |
| 13 | 1 | 100.0 | 2 | 58.3 | 4 | 3.0 | 1 | 10.0 | 2 | 2.5 |
| 14 | 1 | 100.0 | 2 | 58.3 | 5 | 3.0 | 1 | 10.0 | 2 | 2.5 |
| 15 | 2 | 100.0 | 1 | 58.3 | 1 | 2.0 | 1 | 10.0 | 1 | 2.5 |
| 16 | 2 | 100.0 | 1 | 58.3 | 1 | 6.7 | 1 | 10.0 | 1 | 2.5 |
| 17 | 2 | 100.0 | 1 | 58.3 | 1 | 10.8 | 1 | 10.0 | 1 | 2.5 |
| 18 | 2 | 100.0 | 1 | 58.3 | 3 | 2.0 | 1 | 10.0 | 1 | 2.5 |
| 19 | 2 | 100.0 | 1 | 58.3 | 3 | 10.8 | 1 | 10.0 | 1 | 2.5 |
| 20 | 2 | 100.0 | 1 | 58.3 | 1/3 | 1.5/1.5 | 1 | 10.0 | 1 | 2.5 |
| 21 | 6 | 100.0 | 2 | 58.3 | — | — | 2 | 10.0 | 1 | 2.5 |
| 22 | 7 | 100.0 | 2 | 58.3 | 1 | 3.0 | 2 | 10.0 | 1 | 2.5 |
| 23 | 1 | 100.0 | 1 | 58.3 | 6 | 3.0 | 1 | 10.0 | 2 | 2.5 |
| 24 | 1 | 100.0 | 1 | 58.3 | 7 | 3.0 | 1 | 10.0 | 2 | 2.5 |
| 25 | 4 | 100.0 | 7 | 58.3 | 1 | 3.0 | 2 | 10.0 | 1 | 2.5 |

Examples 1 to 20 and Comparative Examples 1 to 5

The coating liquids 1 to 25 shown in Table 6 were respectively applied on to the substrates with a bar coater and dried with hot air of 115° C. to form respective ink-receiving layers each having a thickness of 30 μm, thereby obtaining recording media of Examples 1 to 20 and Comparative Examples 1 to 5.

Evaluation:

Lightfastness

A patch whose RGB value was (255,255,160) was recorded on each of the recording media by using an ink jet recording apparatus imagePROGRAF iPF6400 (manufactured by Canon Inc.) at a printing mode of synthetic paper (starch-free) standard mode and dried for 24 hours. Thereafter, the optical density of the patch was measured by means of an optical reflection densitometer, 500 Spectral Densitometer (manufactured by X-Rite Co.). After the patch was exposed for 200 hours by means of a Xenon Weather Meter Ci4000 (trade name, manufactured by Atlas Co.), the optical density thereof was measured again to calculate an optical density retention according to the following equation:

Optical density retention=(Optical density after the exposure)/(Optical density before the exposure)×100.

Incidentally, the xenon weather meter was operated under the conditions of wavelength 340 nm, irradiation intensity 0.39 W/m$^2$, internal temperature 50° C., relative humidity 70% and rack temperature 63° C. In addition, the higher optical density retention means that the lightfastness of the recording medium is higher. The lightfastness was evaluated according to the following criterion. The evaluated results are shown in Table 7.

4: The optical density retention was 80% or more;

3: The optical density retention was 70% or more and less than 80%;

2: The optical density retention was 60% or more and less than 70%;

1: The optical density retention was less than 60%.

Water Resistance

Running water of 80° C. was caused to flow for 48 hours on a surface of each of the resultant recording media, and the surface was dried overnight. Thereafter, a black paper sheet New Color R (product of Lintec Corporation) was pressed against a surface on the side of the ink-receiving layer of the recording medium with a load of 75 g/cm$^2$ and was bidirectionally scanned 20 times by means of a JSPS-type rubbing color fastness testing machine, AB-301 Color Fastness Rubbing Tester (trade name, manufactured by TESTER SANGYO CO., LTD). The rate of change of optical density of the surface of the black paper sheet (surface on the side pressed against the recording medium) before and after the test was measured by means of an optical reflection densitometer, 500 Spectral Densitometer (manufactured by X-Rite Co.). Incidentally, the higher rate of change of optical density means that the water resistance of the recording medium is lower because a rubbed-off portion of the ink-receiving layer more adheres to the black paper. The water resistance was evaluated according to the following criterion. The evaluated results are shown in Table 7.

4: The rate of change of optical density was less than 20%;

3: The rate of change of optical density was 20% or more to less than 30%;

2: The rate of change of optical density was 30% or more to less than 40%;

1: The rate of change of optical density was 40% or more.

TABLE 7

| | Coating liquid | Evaluated result | |
|---|---|---|---|
| | | Lightfastness | Water resistance |
| Example 1 | 1 | 4 | 4 |
| Example 2 | 2 | 4 | 4 |
| Example 3 | 3 | 4 | 4 |
| Example 4 | 4 | 4 | 4 |
| Example 5 | 5 | 4 | 3 |
| Example 6 | 6 | 4 | 3 |
| Example 7 | 7 | 4 | 4 |
| Example 8 | 8 | 4 | 4 |
| Example 9 | 9 | 4 | 4 |
| Example 10 | 10 | 4 | 3 |
| Example 11 | 11 | 4 | 4 |
| Example 12 | 12 | 4 | 4 |
| Example 13 | 13 | 4 | 4 |
| Example 14 | 14 | 4 | 4 |
| Example 15 | 15 | 3 | 4 |
| Example 16 | 16 | 4 | 4 |
| Example 17 | 17 | 3 | 3 |
| Example 18 | 18 | 3 | 4 |
| Example 19 | 19 | 3 | 3 |
| Example 20 | 20 | 4 | 4 |
| Comparative Example 1 | 21 | 1 | 3 |
| Comparative Example 2 | 22 | 2 | 3 |
| Comparative Example 3 | 23 | 2 | 4 |
| Comparative Example 4 | 24 | 2 | 4 |
| Comparative Example 5 | 25 | 3 | 1 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-071999, filed Mar. 31, 2016, which is hereby incorporated by reference herein in its entirety.

What is claimed is:

1. A recording medium comprising:

a substrate; and an ink-receiving layer, wherein the ink-receiving layer comprises an inorganic particle, a water-insoluble resin, and at least one additive selected from the group consisting of a benzotriazole ultraviolet absorber and a hindered amine photostabilizer, and wherein an average pore radius of the inorganic particle is 5.0 nm or less.

2. The recording medium according to claim 1, wherein the water-insoluble resin is at least one resin selected from the group consisting of an acrylic resin, a polycarbonate-modified urethane resin and a polyether-modified urethane resin.

3. The recording medium according to claim 1, wherein a content of the at least one additive selected from the group consisting of the benzotriazole ultraviolet absorber and the hindered amine photostabilizer with respect to 100.0 parts by mass of the inorganic particle is 2.5 parts by mass or more to 10.0 parts by mass or less.

4. The recording medium according to claim 1, wherein a glass transition point of the water-insoluble resin is 20° C. or less.

5. The recording medium according to claim 1, wherein an oil absorption of the inorganic particle is 150 ml/100 g or more to 240 ml/100 g or less.

6. The recording medium according to claim 1, wherein the inorganic particle comprises wet-process silica.

7. A production process for a recording medium, the process comprising the steps of:

(a) preparing a coating liquid for an ink-receiving layer that comprises an inorganic particle, a water-insoluble resin, and at least one additive selected from the group consisting of a benzotriazole ultraviolet absorber and a hindered amine photostabilizer, and (b) applying the coating liquid for the ink-receiving layer on to a substrate followed by drying, wherein an average pore radius of the inorganic particle is 5.0 nm or less.

8. The recording medium according to claim 1, wherein the substrate comprises a resin-coated substrate, plastic film, or cloth.

9. The recording medium according to claim 1, wherein the average pore radius of the inorganic particle is 1.5 nm or more and 5.0 nm or less.

10. The recording medium according to claim 1, wherein the average secondary particle size of the inorganic particle is 1μm or more and 20μm or less.

11. The recording medium according to claim 1, wherein the content of the water-insoluble resin with respect to 100.0 parts by mass of the inorganic particle is 30.0 parts by mass or more and 80.0 parts by mass or less.

12. The recording medium according to claim 1, wherein the average pore radius of the inorganic particle is 3.5 nm or less.

13. The recording medium according to claim 1, wherein the recording medium is an ink jet recording medium.

* * * * *